United States Patent [19]

Müller

[11] 4,248,066

[45] Feb. 3, 1981

[54] APPARATUS FOR THE CONTINUOUS WET TREATMENT OF STRAND-LIKE TEXTILE MATERIALS

[75] Inventor: Hermann Müller, Herisau, Switzerland

[73] Assignee: Aktiengesellschaft Cilander, Herisau, Switzerland

[21] Appl. No.: 33,216

[22] Filed: Apr. 25, 1979

[30] Foreign Application Priority Data

May 10, 1978 [DE] Fed. Rep. of Germany ..... 2820471

[51] Int. Cl.[3] ..... D06B 3/02

[52] U.S. Cl. ..... 68/43; 68/181 R; 68/DIG. 1

[58] Field of Search ..... 68/43, 175, 181 R, 184, 68/DIG. 1

[56] References Cited

U.S. PATENT DOCUMENTS

| | | | |
|---|---|---|---|
| 1,737,149 | 11/1929 | Cohoe | 68/175 X |
| 2,779,183 | 1/1957 | Fornelli | 68/181 R X |
| 3,285,041 | 11/1966 | Valls | 68/DIG. 1 |
| 3,315,501 | 4/1967 | Muller | 68/181 R |
| 3,533,252 | 10/1970 | Harris | 68/181 R |

*Primary Examiner*—Philip R. Coe

*Attorney, Agent, or Firm*—Werner W. Kleeman

[57] ABSTRACT

An apparatus for the continuous wet treatment of strand-like textile material wherein a treatment liquid flows countercurrent with respect to the direction of movement of the continuously conveyed textile material, and the textile material is squeezed at least once in a pipe or conduit system. A part of the treatment liquid which dams-up or collects in front of the squeezing location, is removed from the pipe system and reintroduced again into the pipe system at a location behind the dam-up region, considered with respect to the direction of flow of the treatment liquid.

2 Claims, 4 Drawing Figures

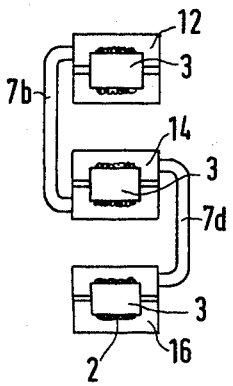
FIG. 4
FIG. 1
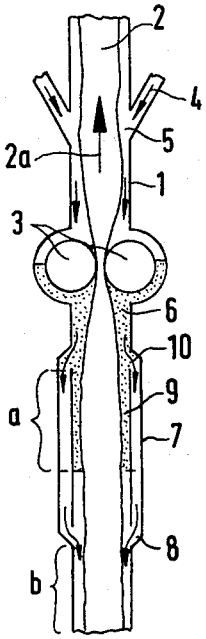
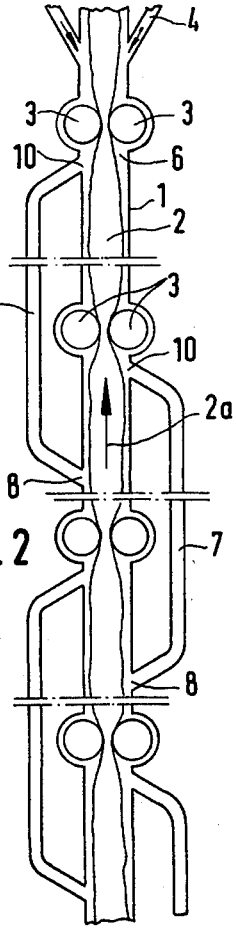
FIG. 2
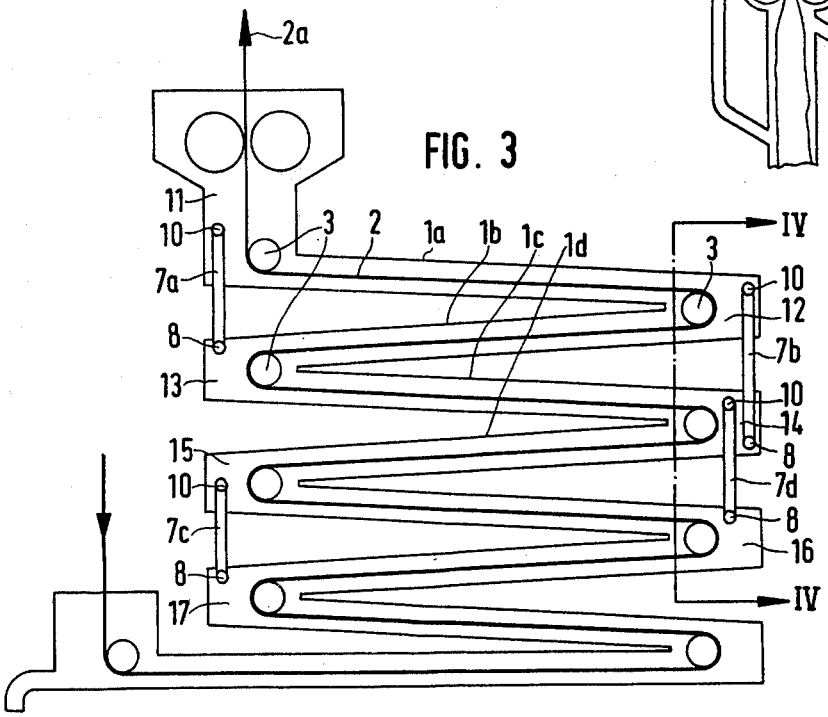
FIG. 3

APPARATUS FOR THE CONTINUOUS WET TREATMENT OF STRAND-LIKE TEXTILE MATERIALS

BACKGROUND OF THE INVENTION

The present invention relates to a new and improved apparatus for the continuous wet treatment of strand-like or rope-like textile material, wherein treatment liquid flows through a pipe system in countercurrent with respect to the direction of movement of the continuously conveyed textile material, and the textile material is squeezed at least once within the pipe system.

With heretofore known methods of this type and equipment for the performance of such methods, for instance as disclosed in Swiss Pat. No. 385,152 or Austrian Pat. No. 202,959, the increased exchange or interaction, which is strived for by the counterflow principle, between the treatment liquid adhering to the textile material and the remaining liquid located in the pipe system, decreases with increasing velocity or speed of movement of the textile material and constant velocity of the treatment liquid. This is so because with increasing velocity there is entrained, by the textile material, a corresponding greater amount of treatment liquid in the same direction of flow.

This undesired effect, as has likewise already been proposed, could be at least partially counteracted by providing relatively larger cross-sectional areas of the pipe or conduit system. Yet, this solution requires an appreciably greater quantity of treatment bath. This, in turn, is contrary to the more recent attempts which are being made, in consideration of the increasingly more stringent requirements regarding protection of the environment, to maintain the liquid consumption as small as possible and to optimumly utilize the treatment agent or liquid.

Also, it is already known to the art, as for instance documented by the previously mentioned patents, to improve the action of a treatment liquid at a textile material by squeezing such textile material once or a number of times during the course of its treatment. The squeezing action is accomplished, for instance, by passing the textile material between squeezing or pinch rolls or guiding such in a zig-zag configuration over deflection rolls which then simultaneously produce a squeezing action at the textile material.

Particularly when using narrow pipe or conduit systems, as such is desired for the purpose of saving on treatment liquid, there is however formed, forwardly of the squeezing location or locations, a slug of treatment liquid, since the squeezed-off treatment liquid tends to collect or dam-up and partially or completely occupies the cross-section of the pipe conduit or the like. Consequently, there is not only impaired a treatment in countercurrent flow within such dam-up or collecting region, rather such damming-up of the treatment liquid also hinders the throughflow of the treatment liquid from one end to the other end of the pipe system.

SUMMARY OF THE INVENTION

Therefore, with the foregoing in mind it is a primary object of the present invention to provide an improved apparatus for the continuous wet treatment of strand-like textile materials in a manner not associated with the aforementioned drawbacks and limitations of the prior art proposals.

Another and more specific object of the present invention aims at an apparatus of the character described, wherein through the use of simple means it is possible, even in a relatively narrow pipe system, to essentially continuously maintain the countercurrent flow principle and at the same time, in comparison to prior art apparatuses working with the countercurrent flow principle, affords an improved utilization of the treatment bath.

Now in order to implement these and still further objects of the invention, which will become more readily apparent as the description proceeds, the inventive method for the continuous wet treatment of strand-like textile material contemplates that part of the treatment liquid which collects or dams-up in front of the squeezing location, is removed from the pipe system and is again reintroduced into the pipe system at a location situated behind the dam-up region, considered with respect to the flow direction of the treatment liquid.

As mentioned, the invention is not only concerned with the aforementioned method aspects, but also pertains to apparatus for the performance thereof, such apparatus comprising a pipe system in which there is arranged at least one squeezing element. At the region of the squeezing element there is arranged the upper end of an auxiliary line or conduit, the lower end of which opens into the pipe system intended for the treatment of the textile material.

The inventive method and the apparatus for the performance thereof can be advantageously employed during bleaching, desizing, washing-out, treatment in a caustic-soda bath, impregnation, dying and similar methods.

By virtue of the fact that the dammed-up treatment liquid or a part thereof, is removed forwardly of the squeezing location, advantageously by means of an auxiliary line or conduit, from the dam-up region and again introduced into the pipe system at a location situated rearwardly of the flow direction, it is firstly possible to reduce the tendency for the damming-up phenomenon to arise, and specifically, to shorten the time of damming-up of the treatment liquid in the pipe system. As a consequence thereof, the textile material is brought into contact, over a longer path, directly with treatment liquid which flows opposite to its direction of movement. At the same time, however, the part of the treatment bath removed by the auxiliary line as excess and ineffectual treatment bath at the dam-up region and again later introduced into the pipe system, is at least partially again entrained by the textile material, and thus, can flow back again in countercurrent flow either in the pipe system or again into the auxiliary line. Consequently, a not inappreciable part of the entire treatment bath thus flows so-to-speak in a pilgrim step from one end of the pipe system to the other. Hence, this part of the treatment bath is effective at the textile material for a longer period of time than if, for instance, in order to avoid the previously mentioned disadvantageous damming-up of the treatment bath, there were used very large pipe cross sections, or also the textile material were moved at extremely low velocities. In addition to the foregoing, a further advantage of the invention resides in the fact that the treatment bath experiences an increase in velocity between the location at which it is removed from the pipe system and the location where it is again reintroduced into the pipe system. Consequently, there is not only avoided the formation of a slug at the opening or mouth location, rather there is augmented the countercurrent flow in the pipe system.

Hence, by virtue of the measures contemplated by the invention, there is appreciably increased the efficiency in contrast to known methods, in relation to the quantity of employed treatment liquid.

It is particularly advantageous to again infeed the treatment liquid which has been removed at the dam-up region of the squeezing elements, to the pipe system at a location where the liquid flow does not completely fill the cross-sectional area of the pipe system. This can be for instance accomplished according to an embodiment of the inventive apparatus, wherein the pipe system comprises a number of interconnected pipes or conduits which are arranged above one another in a zig-zag configuration. Further, the connection locations between such pipes and serving for housing deflection rolls, simultanteously functioning as squeezing elements, are widened into chambers or compartments. Importantly, the invention contemplates in this regard, by way of example, that at the region of the deflection roll or the deflection rolls, in other words at the chamber where such deflection roll or rolls are arranged, there is arranged the outlet opening, and such auxiliary line leads to a connection location between two pipes and which connection location is located therebelow, and opens into the there situated chamber or compartment.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a longitudinal sectional view through a first exemplary embodiment of inventive apparatus:

FIG. 2 is a variant construction of apparatus from that shown in FIG. 1;

FIG. 3 shows a still further embodiment of inventive apparatus; and

FIG. 4 is a schematic sectional view of the arrangement of FIG. 3, taken substantially along the line IV-IV thereof.

DETAILED DESCRIPTION OF THE PREFERRED EMBODIMENTS

Describing now the drawings, and referring specifically to the arrangement of FIG. 1, it will be seen that the essentially strand-like or rope-like textile material 2 is guided, in the direction indicated by the arrow 2*a*, from the bottom towards the top through a relatively narrow, essentially vertically arranged pipe or tube 1 or equivalent structure. The treatment liquid 4 is introduced, at the liquid inlet location 5, with or without being pressurized, into the pipe 1 and then flows in countercurrent with respect to the direction of movement 2*a* of the textile material 2 downwardly through the pipe 1. Within the pipe length the textile material 2 is squeezed by means of two squeezing or pressure rolls 3 or equivalent structure, which can be driven or non-driven. The squeezed-out treatment liquid tends to dam-up or collect below the squeeze rolls 3 in the chamber or compartment 6, since owing to the quantity of treatment liquid entrained by the strand or textile material 2, and which quantity of entrained treatment liquid is indicated by reference character 9, such cannot flow rapidly enough, at this pipe location, through the pipe 1. Merging in flow communication with the chamber of compartment 6 is an auxiliary line or conduit 7 which, in the embodiment under discussion, is constructed as a pipe or tubular jacket surrounding the pipe 1. The auxiliary line or conduit 7 flow communicates at its upper end by means of the outlet openings 10 with the chamber 6 and at its lower end by means of inlet openings 8 with the pipe 1. A part of the dammed-up treatment liquid thus enters the pipe jacket or shell 7 and flows, externally of the not paticularly referenced wall of the pipe 1, towards the inlet location of inlet openings 8 where it again flows back into the pipe 1. The dam-up zone a is thus bypassed by the squeezed-off and newly infed treatment liquid, so that the counter flow principle is again established in the zone or region b located below the inlet openings 8, with the same quantity of treatment liquid.

FIG. 2 illustrates a further exemplary embodiment of apparatus constructed according to the invention, which here is provided with a number of squeezing devices. Also with this embodiment the pipe system comprises an essentially vertically extending pipe 1 having one or more infeed openings 4 for the treatment liquid. Within this pipe 1, the cross-section of which can have a random shape and can be accommodated to the textile material 2 to be treated, there are arranged a number of pairs of squeeze or pressing rolls 3. The auxiliary lines comprise pipe lines or conduits 7, the upper ends of which, in each case, are located directly below the related squeeze rolls 3 and the lower ends of which open between two successive pairs of squeeze rolls 3 into the pipe 1. The auxiliary lines 7 are arranged in offset relationship, as shown, so that the liquid is guided from each squeezing location to the next lower pipe section. In this way there is brought about the beneficial result that the treatment liquid which flows-off through an auxiliary line, does not flow-off through the next following auxiliary line and thus does not come into contact with or only in insufficient contact with the textile material 2. On the other hand, by virtue of the described arrangement of the auxiliary lines 7 there is insured for a uniform flow of the infed treatment liquid throughout the entire pipe system. This also is the case if the system is operated with different speeds of movement of the textile material and with the textile material having varying running weight per meter.

Now in FIGS. 3 and 4 there is shown a further exemplary embodiment of apparatus designed according to the invention. Here, the pipe system consists of a multiplicity of pipes or conduits 1*a*, 1*b*, 1*c*, 1*d* and so forth which are arranged in a zig-zag configuration in relation to one another and interconnected in flow communication with one another. The connection of the individual pipes 1*a*, 1*b*, 1*c*, 1*d* and so forth is accomplished by means of chambers or compartments 11, 12, 13, 14, 15, 16, 17, and in each such compartment there is arranged a respective deflection roll 3 for the textile material 2.

At the region of such deflection rolls 3, which are effective as squeezing rolls for the textile material 2 which is guided thereover, there are arranged the auxiliary lines or conduits 7*a*, 7*b*, 7*c* and 7*d*, and specificially, each auxiliary line flow communicates each two respective chambers or compartments which are situated above one another. Hence, it will be seen that the line or conduit 7*a* flow communicates the chamber 11 and 13, the line 7*b* the chambers 12 and 14, the line 7*c* the chambers 15 and 17, and finally, the line *7d* the chambers 14 and 16.

During operation of this equipment, the textile material 2, which is pulled upwardly with a tensile load in the direction of the arrow *2a*, is automatically squeezed during its deflection about each of the deflection rolls 3, so that part of the treatment liquid is removed from the strand-like textile material 2. The squeezed quantity of treatment liquid causes a damming-up of the treatment liquid over the level of the corresponding outlet opening of the related auxiliary line *7a*, *7b*, *7c*, *7d*, as the case may be, so the treatment liquid can flow through the auxiliary lines *7a*, *7b*, *7c*, *7d* into the respective chambers or compartments 11, 12, 13, 14, 15, 16, 17 located therebelow.

The arrangement of the auxiliary lines or conduits *7a*, *7b*, *7c* and *7d* can be different. Although, in the previously explained manner, the auxiliary lines *7a* and *7c* connect a deflection chamber with the next lower situated deflection chamber and each deflection chamber possesses either only one outlet opening or one inlet opening (chambers 11, 13, 15, 17), it is also possible to have one or more of the chambers (such as the chamber 14) possess both an inlet opening for the line *7b* as well an outlet opening for the line *7d*. Advantageously, within the chamber 14 the outlet opening of the line *7d* is located at a higher elevational position than the inlet opening of the line *7b*.

When using the lines or conduits *7b* and *7d*, which interconnect each chamber with the chamber situated therebelow, there alternately comes into play the one auxiliary line *7b* or the other auxiliary line *7d*, in that, for instance, upon increasing the travel speed of the textile material during the through-passage there is likewise increased the quantity of entrained treatment liquid, so that in this case the auxiliary line *7d* is effective until the liquid level has dropped below the liquid outlet location of the auxiliary line or conduit *7d*. On the other hand, the treatment liquid flows through the auxiliary line *7b*, without the auxiliary line *7d* becoming effective, for instance then when during the continuous passage of the textile material the latter suddenly travels through the installation at a smaller running weight per meter, and therefore, the treatment liquid initially entrained by the heavier textile material suddenly flows more rapidly through the pipe sections, whereby there is only temporarily caused a damming-up of treatment liquid in the chamber 12, not however in the chamber 14.

From the showing of FIG. 4 it will be apparent how the strand-like textile material 2 is automatically pressed flat by means of the deflection rolls 3, so that part of the treatment liquid is pressed out of the strand-like textile material.

Also, it can be advantageous to increase the flow velocity of the withdrawn treatment liquid, especially when working with essentially horizontal pipes. In this case it is advantageous if the auxiliary lines or conduits 7 do not lead from one deflection chamber into the next lower deflection chamber, rather extend from one chamber into the second or third following lower chamber.

By means of the described method there is realized, particularly during washing-out processes, an outstanding utilization of the infed washing bath. This is so because the washing bath, owing to the alternate periodic flow in the same direction as the movement of the textile material and the periodic counterflow, is utilized a number of times during the entire passage of the textile material through the equipment, and the same liquid has a longer residence time in the equipment due to the periodic flow in the same direction as the movement of the textile material, and thus, remains for a longer period of time in contact with the textile material.

While there are shown and described present preferred embodiments of the invention, it is to be distinctly understood that the invention is not limited thereto, but may be otherwise variously embodied and practiced within the scope of the following claims. Accordingly, 9n

What I claim is:

1. An apparatus for the continuous wet treatment of strand-like textile material, comprising:

a pipe system through which the textile material moves in a predetermined direction;

means for infeeding treatment liquid moving in countercurrent with respect to the predetermined direction of movement of the textile material for contact with the textile material;

at least one squeezing means provided for the pipe system for squeezing the textile material which is contacted by the treatment liquid;

an auxiliary line having an upper end and a lower end;

the upper end of said auxiliary line being arranged at the region of the squeezing means;

the lower end of the auxiliary line opening into the pipe system through which travels the textile material to be treated;

said pipe system comprising an essentially vertically extending pipe;

said squeezing means comprising at least one pair of coacting squeeze rolls between which there is passed the textile material; and said auxiliary line having a starting portion located below the squeeze rolls.

2. An apparatus for the continuous wet treatment of strandlike textile material, comprising:

a pipe system through which the textile material moves in a predetermined direction;

means for infeeding treatment liquid moving in countercurrent with respect to the predetermined direction of movement of the textile material for contact with the textile material;

at least one squeezing means provided for the pipe system for squeezing the textile material which is contacted by the treatment liquid;

an auxiliary line having an upper end and a lower end;

the upper end of said auxiliary line being arranged at the region of the squeezing means;

the lower end of the auxiliary line opening into the pipe system through which travels the textile material to be treated;

said pipe system comprising a number of essentially zig-zag arranged pipes disposed above one another;

means for interconnecting each two superimposed pipes;

said interconnecting means providing connection locations between each two superimposed pipes;

deflection roll means defining said squeezing means arranged at least at predetermined ones of said connection locations;

said auxiliary line having an outlet opening arranged at the region of at least one of the deflection roll means;

said outlet opening leading into a pipe located therebelow; and said auxiliary line extends from a connection location between two pipes to a connection location between two pipes located below said first mentioned two pipes.

* * * * *